US006012453A

United States Patent [19]

Tsals et al.

[11] Patent Number: 6,012,453

[45] Date of Patent: Jan. 11, 2000

[54] APPARATUS FOR WITHDRAWAL OF LIQUID FROM A CONTAINER AND METHOD

[75] Inventors: Izrail Tsals, Sudbury, Mass.; Dominick J. Frustaci, Williamsville, N.Y.; Scott J. Hynek, Waltham, Mass.

[73] Assignee: Figgie Inernational Inc., Mayfield Heights, Ohio

[21] Appl. No.: 08/951,138

[22] Filed: Oct. 15, 1997

Related U.S. Application Data

[63] Continuation-in-part of application No. 08/425,916, Apr. 20, 1995, abandoned.

[51] Int. Cl.[7] ..... A62B 7/06; F17C 7/02

[52] U.S. Cl. ..... 128/201.21; 128/913; 62/50.1

[58] Field of Search ..... 128/201.21, 200.24, 128/913; 62/50.1

[56] References Cited

U.S. PATENT DOCUMENTS

| | | | |
|---|---|---|---|
| Re. 33,567 | 4/1991 | Killip et al. | 73/863 |
| 1,395,753 | 11/1921 | Wehle . | |
| 1,845,136 | 2/1932 | Dieter . | |
| 1,955,308 | 4/1934 | Naftel et al. | 137/21 |
| 2,583,932 | 1/1952 | Daebelliehn | 220/4 |
| 2,970,452 | 2/1961 | Beckman et al. | 62/51 |
| 2,990,695 | 7/1961 | Leffingwell, Jr. | 62/223 |
| 3,046,751 | 7/1962 | Gardner | 62/52 |
| 3,097,497 | 7/1963 | Fitt | 62/52 |
| 3,318,307 | 5/1967 | Nicastro | 128/142 |
| 3,332,411 | 7/1967 | Bloom et al. | 123/196 |
| 3,570,481 | 3/1971 | Woodberry, Jr. | 128/142 |
| 3,572,048 | 3/1971 | Murphy | 62/52 |
| 3,679,092 | 7/1972 | Sullivan | 220/85 |
| 3,699,775 | 10/1972 | Cowans | 62/55 |
| 3,706,208 | 12/1972 | Kadi et al. | 62/55 |
| 3,707,078 | 12/1972 | Cramer | 62/50 |
| 3,869,871 | 3/1975 | Rybalko et al. | 62/178 |
| 3,892,273 | 7/1975 | Nelson | 165/105 |
| 4,211,086 | 7/1980 | Leonard et al. | 62/50 |
| 4,218,892 | 8/1980 | Stephens | 62/514 |
| 4,370,809 | 2/1983 | Takahashi et al. | 30/381 |
| 4,602,656 | 7/1986 | Nagashima et al. | 137/590 |
| 4,750,551 | 6/1988 | Casey | 376/367 |
| 4,756,310 | 7/1988 | Bitterly | 128/400 |
| 4,835,866 | 6/1989 | Nagashima | 30/381 |
| 5,086,619 | 2/1992 | Huang et al. | 62/50 |
| 5,243,826 | 9/1993 | Longsworth | 62/51 |
| 5,353,835 | 10/1994 | Mills | 137/381 |
| 5,417,073 | 5/1995 | James et al. | 62/51 |
| 5,438,837 | 8/1995 | Caldwell et al. | 62/50 |

FOREIGN PATENT DOCUMENTS

| | | |
|---|---|---|
| 467014 | 8/1950 | Canada . |
| 414107 | of 0000 | Germany . |
| WO9408177 | 4/1994 | WIPO . |

*Primary Examiner*—Aaron J. Lewis
*Assistant Examiner*—Todd Martin
*Attorney, Agent, or Firm*—Hodgson, Russ, Andrews, Woods & Goodyear LLP

[57] ABSTRACT

An apparatus that provides for withdrawal of the liquid contents from a closed container 14 independent of the spatial orientation thereof, is described. The liquid withdrawal apparatus includes flexible withdrawal conduits 58 disposed inside the container and in fluid flow communication with external heat exchangers 144, 146. The heat exchangers serve to transfer heat to the withdrawn liquid to thereby provide a breathable gas mixture. The upstream end of the withdrawal conduits 58 are provided with a weighted pick-up means comprising a wicking material that draws liquid into the interior thereof to ensure contact of the liquid with the conduits, even when the supply of liquid is nearly depleted. A pressure differential between the inside of the container and the external heat exchangers, normally brought about by an inhalation event of the user, provides the motive force for withdrawing the liquid contents from the container through the conduits.

29 Claims, 6 Drawing Sheets

APPARATUS FOR WITHDRAWAL OF LIQUID FROM A CONTAINER AND METHOD

CROSS-REFERENCE

The present application is a continuation-in-part application of application Ser. No. 08/425,916, filed Apr. 20, 1995, now abandoned.

BACKGROUND OF THE INVENTION

1. Field of the Invention

The present invention generally relates to liquid withdrawal from a container. More particularly, the present invention relates to an apparatus that provides for withdrawal of the liquid contents from a closed container, independent of the spatial orientation thereof. The apparatus is useful in a self contained breathing apparatus (SCBA) type respirator for withdrawal of a liquefied breathable gas mixture from the container. However, in a broad sense, the present apparatus is useful for withdrawal of any liquid from a closed container by the pressure differential communicated between the inside of the container and a removal means located outside the container through a flexible conduit.

One preferred embodiment of the liquid withdrawal apparatus of the present invention includes a flexible conduit disposed inside a container and in fluid flow communication with an external heat exchanger. The heat exchanger serves to input heat energy from the ambient atmosphere to the withdrawn liquid to thereby provide a breathable gas mixture. The upstream end of the flexible conduit is provided with a weighted pick-up means that is either submerged in the liquid, or rests on or slightly submerged below the surface of the liquid to ensure only liquid withdrawal, independent of the spatial orientation of the container. Preferably, the pick-up means comprises a wicking material that draws the liquid into the interior thereof to further ensure contact of the liquid with the upstream open end of the conduit means. The flexible conduit then transmits through a pressure barrier at the container outlet to communicate with the heat exchanger. The pressure barrier seals around the flexible conduit to ensure that there is little to no communication of pressure between the inside of the container and the heat exchanger, other than the fluid flow communication path provided by the conduit itself. A pressure differential between the inside of the container and the external heat exchanger, normally brought about by an inhalation event of the user, provides the motive force for withdrawing the liquid contents from the container through the flexible conduit. Pressure inside the container is maintained through vaporization of the liquid contents which is saturated to some pressure, P, of about 100 psig, for example.

2. Prior Art

Various devices are known in the prior art for liquid withdrawal from a container associated with a breathing apparatus. German Patent No. 414107 relates to a respirator for liquid gases comprising a liquid gas receptacle having a pressure-compensating line and siphon line that are in large part non-rigid, flexible tubes. In one embodiment, the lowest end of the pressure-compensating line is mounted to a float so that at any position of the device, the inner orifice of the pressure-compensating line remains in the evaporation space while the siphon line is mounted to a weight so that the inner orifice thereof remains constantly immersed in the liquid. In another embodiment, both the pressure-compensating line and the siphon line are carried by the float in such a way that their orifices are in the evaporation space and immersed in the liquid, respectively. Other than being described as flexible, the material of construction of the pressure-compensating line and the siphon line in both embodiments is not further described. Further, the weight is not described as including a wicking material to ensure contact of the siphon line with the liquid gas at all times, for example when the liquid contents are nearly depleted.

U.S. Pat. No. 3,572,048 to Murphy describes an omnipositional cryogenic underwater breathing apparatus comprising a reservoir tank having two weighted liquid air pick-up tubes disposed transverse through the length of the tank. The pick-up tubes each are in turn connected to coiled tube sections which have spring like properties that permit the weighted ends of the pick-up tubes to fully move about the cross-section of the reservoir under the force of gravity. The coiled tube sections are not flexible and they do not permit movement of the pick-up tubes about the entire volume enclosed by the tank, as in the present invention.

U.S. Pat. No. 3,318,307 to Nicastro describes a breathing pack for converting liquid air or liquid oxygen into a breathable gas. This device includes a weighted liquid withdrawal tube extending laterally outwardly from a lower swivel. The lower swivel is connected by a pivot tube to an upper swivel which in turn has a gas pressurizing tube extending laterally outwardly therefrom, but in an opposite direction with respect to the liquid withdrawal tube. The weighted liquid withdrawal tube ensures that the liquid contents are fed to a heat exchanger to vaporize the liquid. However, the liquid withdrawal tube is not flexible and it would not be in contact with the liquid contents in all intended orientations of use of the container, for example, if the container was positioned upside down.

In the prior art apparatuses, the various withdrawal structures do not ensure liquid removal throughout the entire volume of the container particularly when the liquid quantity is low. The weighted pick-up head of the present invention is an improvement over the prior art in that the liquid withdrawal conduit is flexible and its pick-up end is provided with a wicking material so that, the upstream open end of the conduit contacts the liquid, even when the quantity of liquid is nearly depleted. When the container is incorporated as part of a SCBA and the liquid contents are a liquefied, breathable gas mixture, the construction of the present liquid withdrawal apparatus ensured that even in low liquid quantity situations withdrawn liquid continues to flow to the endothermic heat exchanger, which transfers heat energy from the ambient atmosphere to the liquid to vaporize the liquid to a breathable gas. This could be extremely important for saving a user's life if that person was trapped and their breathable liquefied-gas supply was running low. Furthermore, the weighted pick-up head ensures that only the liquid contents are removed from the container, devoid of any of the gaseous head, to provide the breathable gas having concentrations of the various constituents at a similar relative content as they are in the liquid phase. In other words, vaporization of the liquid contents only occurs in the heat exchangers at a rate relative to consumption at the facepiece. In this manner, the oxygen content of the vaporized gas remains at a concentration level similar to that of the cryogenic liquid.

U.S. Pat. Nos. Re. 33,567 to Killip et al., 5,417,073 to James et al., 5,243,826 to Longsworth, 4,756,310 to Bitterly, 4,750,551 to Casey and 4,218,892 to Stephens describe various apparatus having wicking material for conducting a liquid. However, none of these patents contemplates the use of a wicking material provided at the pick-up end of a liquid withdrawal conduit to ensure contact of the liquid with the conduit, even when the liquid is nearly depleted.

SUMMARY OF THE INVENTION

The liquid withdrawal apparatus of the present invention includes a flexible conduit provided with a pick-up head at an upstream end thereof. The pick-up head is provided with a wicking material that keeps the withdrawal conduit in contact with the liquid contents of a liquefied-gas container at all times, especially when the liquid contents are nearly depleted and independent of the spatial orientation of the container. Preferably, the withdrawal conduit comprises a multiplicity of relatively small diameter, flexible tubes.

In one embodiment of the present invention, the pick-up head is an asymmetrically weighted flotation device that ensures that the pick-up end of the withdrawal conduit is always submerged below the liquid surface rather than in communication with the gaseous head. The outlet end of the withdrawal conduit delivers the liquid contents to one or more endothermic heat exchangers, sufficiently downstream from the Dewar container to ensure rapid vaporization of the liquid to a warmed, breathable gas. A barrier structure such as a septum and the like, is provided at the entrance to the heat exchanger, upstream from the outlet end of the withdrawal conduit to ensure that there is little to no communication of pressure (and consequently fluid) from the inside of the Dewar to the heat exchanger, other than the pressure communication path provided by the withdrawal conduit itself. It is the pressure differential between the inside of the Dewar container, as generated by the liquid saturated to some pressure $P_d$, and the pressure in the heat exchange $P_h$, which is the driving force for delivering liquid to the heat exchanger.

In a multi-component liquid, such as a liquefied, breathable gas mixture comprising nitrogen and oxygen, it is important to withdrawal only liquid from the container. The withdrawn liquid is than vaporized to a gaseous phase. Since the liquid is vaporized in a relatively closed system, i.e., in the heat exchanger, the percentage of the various constituents in the gaseous phase is similar to the liquid phase. Thus, the present invention prevents withdrawal from the head space of the container. Withdrawal from the head space is undesirable because the constituent with the lower vapor pressure, i.e., nitrogen, flashes before oxygen to give a nitrogen rich gas at the breathing regulator.

These and other aspects of the present invention will become more apparent to those skilled in the art by reference to the following description and to the appended drawings.

DETAILED DESCRIPTION OF THE INVENTION

Figure 1:
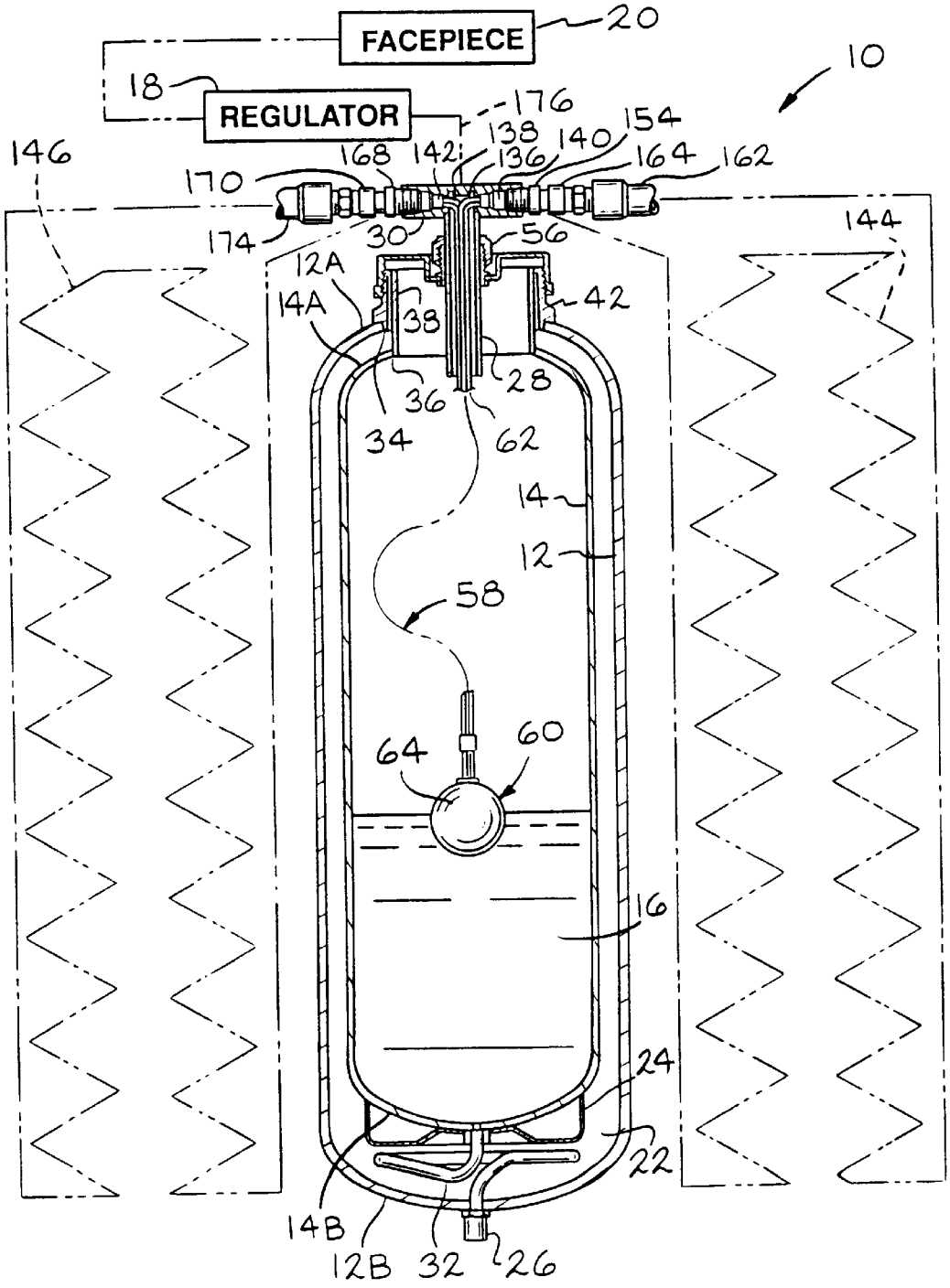
FIG. 1 is a view, partly elevational, partly cross-sectional, partly schematic and partly in block diagram of a Dewar container 10 including a liquid withdrawal conduit means 58 of the present invention associated with a pick-up head-means 60 floating on the surface of the cryogenic liquid 16.
Figure 4:
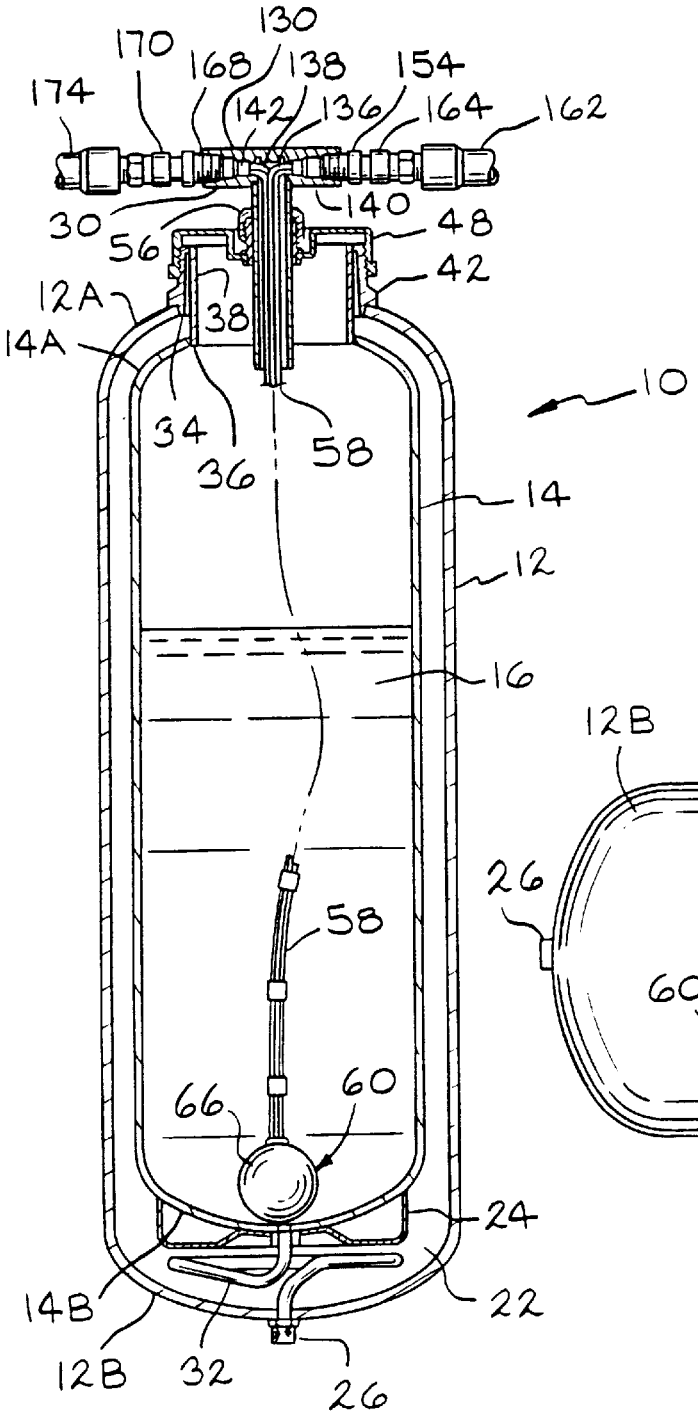
FIG. 4 is a partial elevational, partial cross-sectional view of the Dewar container 10 shown in FIG. 1 provided with a sinker-type liquid pick-up head means submerged in the cryogenic liquid 16.
Figure 10:
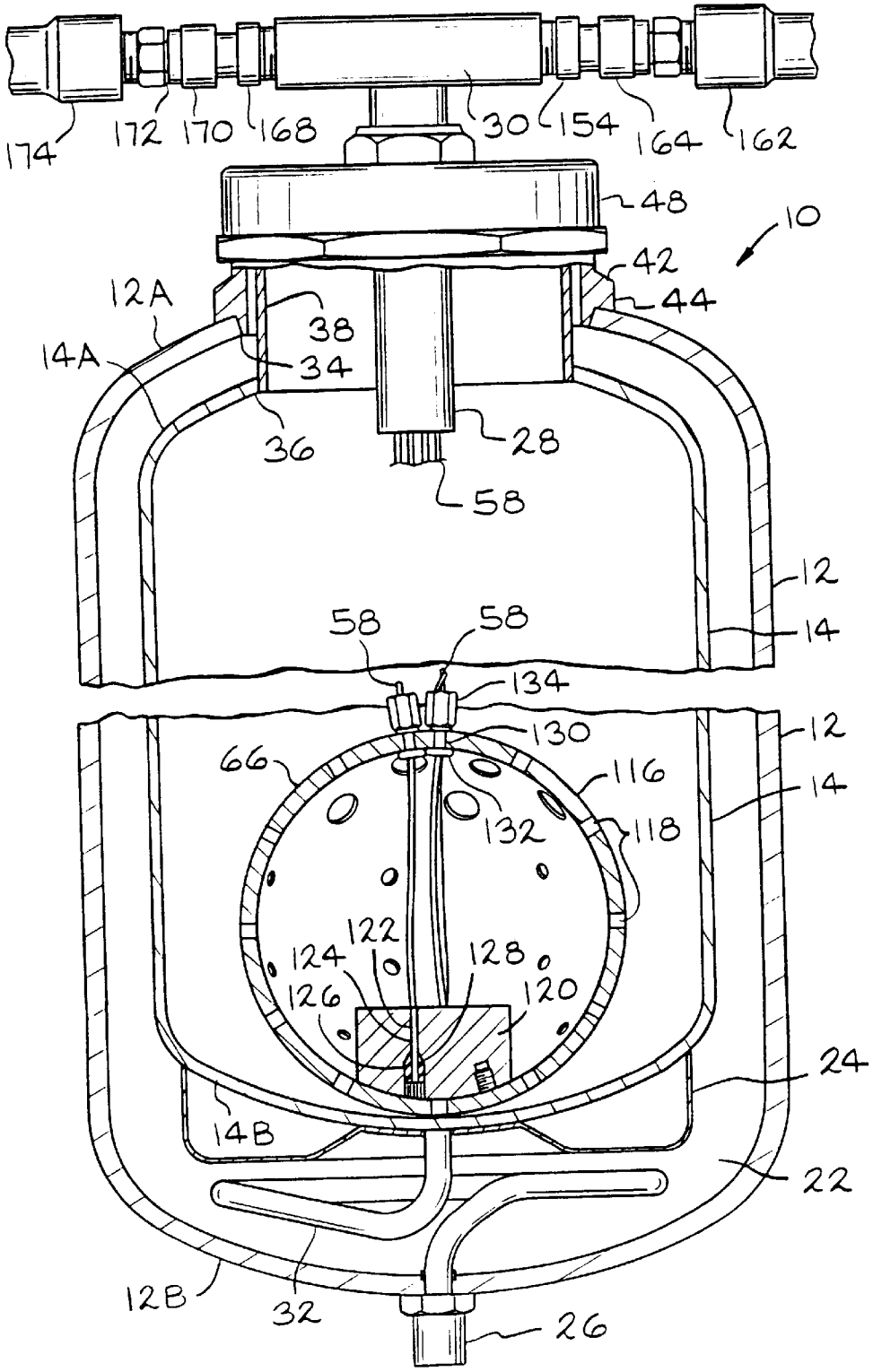
FIG. 10 is an enlarged and broken away, partial elevational, partial cross-sectional view of the Dewar container 10 according to the present invention including a sinker-type pick-up head 116.

Turning now to the drawings, FIGS. 1, 4 and 10 show a cryogenic fluid Dewar container 10, partly in elevation, partly in schematic and partly in cross-section, which is suitable for use with the liquid withdrawal apparatus of the present invention. It should be understood that container 10 is merely exemplary, and in that respect, container 10 represents one embodiment of a container that is useful with the liquid withdrawal apparatus of the present invention. In other words, the present liquid withdrawal apparatus is useful with many types of containers whose shape and construction are only limited by the imagination of those skilled in the art. For example, while container 10 is shown having a generally cylindrical shape closed at both ends, the present liquid withdrawal apparatus can be adapted for use with containers having a myriad of shapes other than cylindrical. However, the container does need to be closed.

The cryogenic liquid Dewar container 10 comprises an outer container means or outer shell 12 mounted around and surrounding an inner container means or inner shell 14 containing a cryogenic liquid 16. The cryogenic liquid 16 is a liquefied-gas mixture capable of supplying a breathable gas mixture to a breathing regulator 18 and an associated facepiece 20, as indicated in block diagram representation in FIG. 1.

The outer shell 12 has a generally cylindrical side wall extending along and around the longitudinal axis of the container 10 with first and second dome portions 12A and 12B closing the opposed ends thereof. Similarly, the inner shell 14 has a cylindrical side wall extending along and around the longitudinal axis with first and second dome portions 14A and 14B closing the opposed ends thereof. The space 22 formed between the coaxially aligned outer and inner shells 12 and 14 is evacuated and provided with an insulation material (not shown) that helps to thermally insulate the cryogenic liquid 16 from the ambient environment. A getter material 24 is mounted on the outside of the second dome 14B of the inner shell 14 to remove any residual gases in the evacuated space 22 between the shells 12 and 14 by a sorption process. This insulation structure is typically referred to as super insulation and is commonly used in the construction of liquefied gas containers.

A liquid fill valve 26 is mounted on the second dome 12B of the outer shell 12. Valve 26 serves as a connection means for connecting the Dewar container 10 to a pressurized liquefied-gas supply (not shown) for filling the cryogenic liquid 16 into the inner shell 14.

A tube 28 supports a manifold block 30 positioned spaced above the first dome 14A of the inner shell 14, as oriented with respect to FIG. 1. Tube 28 depends into the interior of the inner shell 14, to provide a vent space where a gas pocket forms to prevent the inner shell from being overfilled, as is well known to those skilled in the art. The saturation vapor pressure of the cryogenic liquid 16 inside the inner shell 14 is about 60 psig minimum, and more preferably at about 100 to 130 psig. The system will however operate at liquid saturation pressures well below 60 psig. A relief valve (not shown), compatible with cryogenic fluids, communicates with the interior of the inner shell 14. In case of over pressurization of the inner shell, the relief valve is set to actuate at about 140 psig.

Valve 26 leads to a gas trap 32 forming a 360 degree loop in the insulating space 22 between the shells 12 and 14. When valve 26 is closed and with cryogenic liquid 16 provided in the inner shell 14, there will always be a high side of the trap 32 that is filled with gas. The difference in the coefficient of heat transfer of a gas compared to a liquid is on the order of magnitude of about ten to as much as a thousand for a boiling liquid. That way, trap 32 helps prevent ambient heat from conducting to the cryogenic liquid 16 in the inner shell 14.

As shown in FIGS. 1, 4 and 10, a first opening 34 is provided in the upper dome 12A of the outer shell 12 and a second opening 36 is provided in the upper dome 14A of the inner shell 14. The perimeter of opening 34 is spaced from a cylinder 38 having its lower end secured to the perimeter of the second opening 36 aligned along the longitudinal axis of the container 10.

An annular flange 42 has an enlarged base portion 44 secured to the perimeter of opening 34, spaced from the side wall of cylinder 38 with an inwardly extending upper annular rim 46 secured to the cylinder 38 adjacent to the annular connection. A cap 48 is threaded on flange 42. Cap 48 is provided with a central recess 50, a bottom wall 52 of which has an opening. Bottom wall 52 supports a sleeve 54 fitted in a closely spaced relationship around a portion of the tube 28 communicating between the interior of the inner shell 14 and the exterior thereof. A compression nut 56 is threaded on sleeve 54 to align the tube 28 and the manifold block 30.

Tube 28 partially sheaths a flexible liquid withdrawal conduit means 58 (shown partly in elevation and partly in dashed lines in FIGS. 1 and 4) having an end disposed inside of a pick-up head means 60 (FIGS. 1, 4 and 5) that ensures that the pick-up end of the conduit means 58 is always submerged below the surface of the cryogenic liquid 16, independent of the spatial orientation of the container 10. The pick-up means 60 preferably has a spherical shape with a polished finish. This allows the pick-up head means 60 to translate on the inner surface of the inner shell 14 and decreases the coefficient of sliding friction between the pick-up head means 60 and the inner shell 14. To enhance translation of the pick-up means 60 inside the inner shell 14, the inner surface of the inner shell preferably have a continuously curved configuration (not shown in FIGS. 1, 4, 5 and 10).

The liquid withdrawal conduit means 58 is of a polymeric material that is not adversely affected by contact with the cryogenic liquid 16. Preferably, there are four or more small diameter conduits 58 made of a synthetic polymeric material, such as polytetraflouroethylene having an inside diameter of between about 0.020 to 0.040 inches, 0.030 inches being preferred with about a 0.006 to 0.010 inch wall thickness. Also, the tubes can be sheathed for additional mechanical strength.

Several embodiments of the liquid pick-up head means 60 and associated liquid withdrawal conduit means 58 will now be described in detail.

Figure 5:
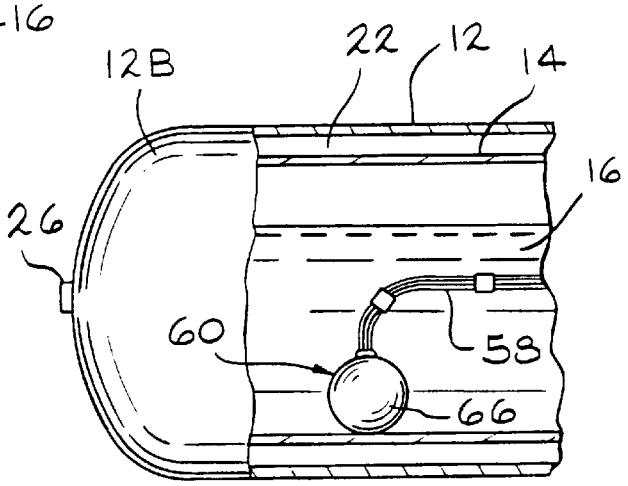
FIG. 5 is a broken away, partial cross-sectional view of the Dewar container 10 shown in FIG. 4 rotated 90 degrees into a horizontal position.

The first type consists of a float-type pick-up head (FIG. 1) which rests on the surface of the cryogenic liquid 16. Float 64 is asymmetrically weighted to ensure that the pick-up end of the liquid withdrawal conduit means 58 is always in contact with the cryogenic liquid 16 as the liquid moves in the inner shell 14 in response to changing Dewar container 10 orientations. Another type of liquid pick-up head means 60 comprises a weighted member, such as a sinker-type 66, as shown in FIGS. 4 and 5. In this latter embodiment, the pick-up end of the liquid withdrawal conduit means 58 is submerged in the cryogenic liquid 16 with the sinker 66 readily following the low side (FIG. 5) of the inner surface of the inner shell 14. That way, the sinker 66 ensures that the liquid withdrawal conduit means 58 is always in fluid flow communication with the liquid 16 until the liquid is essentially depleted from the inner shell 14, independent of the spatial orientation thereof.

Various embodiments of the pick-up head means comprising the float-type 64 and the sinker-type 66 will be described in detail presently.

Figure 3:
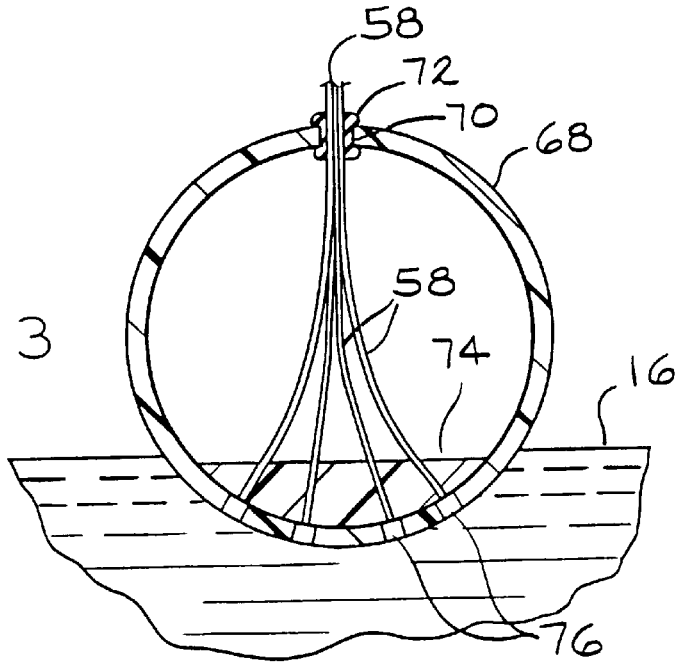
FIG. 3 is a cross-sectional view of one embodiment of a float-type liquid pick-up head means of the present invention.

As shown in FIG. 3, one embodiment of the float-type liquid pick-up head comprises a spherically-shaped member 68 having a main opening 70 provided with a grommet 72. The liquid withdrawal conduit means 58 pass through the grommet 72 and extend to a differential weight 74 disposed inside the sphere 68 opposite the main opening 70. The pick-up end of the four withdrawal conduits 58 each terminate at respective openings 76 in the sphere 68. This structure maintains each of the withdrawal conduits 58 in fluid flow communication with the cryogenic liquid 16 in the inner shell 14 as the sphere 68 rests on the surface thereof.

Figure 6:
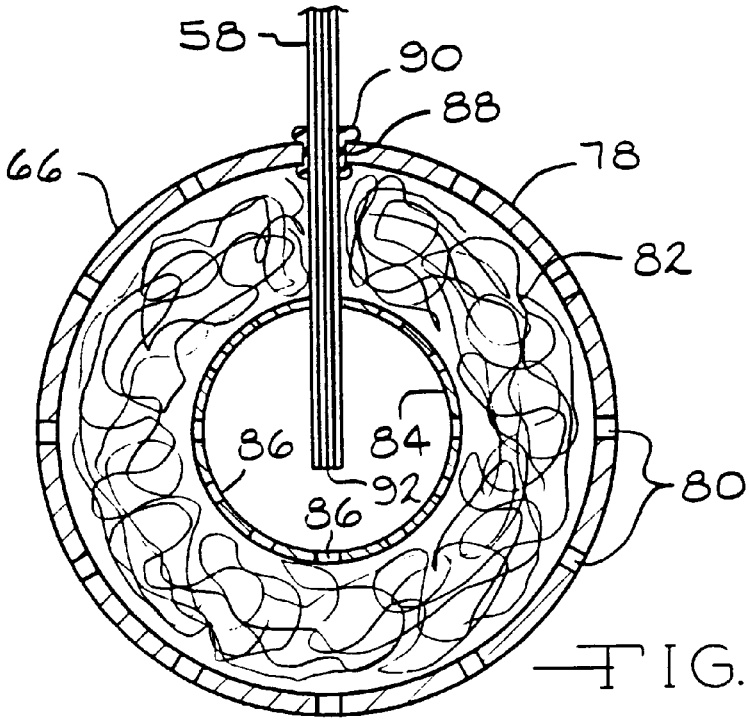
FIG. 6 is a cross-sectional view of another embodiment of a sinker-type liquid pick-up head means according to the present invention.
Figure 7:
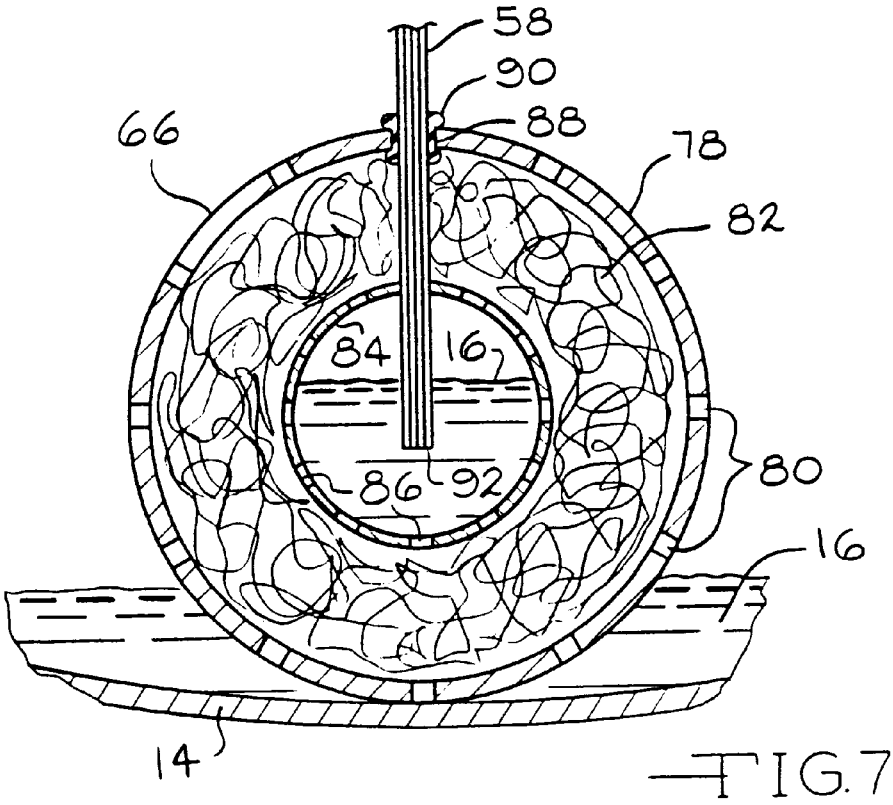
FIG. 7 is a cross-sectional view of the sinker-type liquid pick-up head means shown in FIG. 6 partially immersed in the cryogenic liquid 16.

FIGS. 6 and 7 show one embodiment of a sinker-type 66 liquid pick-up head comprising a spherically-shaped member 78. Sphere 78 has a plurality of openings or perforations 80 therein for fluid flow communication of the cryogenic liquid 16 into the interior of the sphere 78. A wicking material 82, such as a felt material and the like, is disposed inside the sphere 78 supporting a secondary sphere 84 at a central location therein. The secondary sphere 84 is also hollow with a plurality of openings or perforations 86 that provide for fluid flow communication of the cryogenic fluid 16 therein. The sphere 78 includes a main opening 88 provided with a grommet 90 having the withdrawal conduits 58 passing therethrough. The withdrawal conduits 58 enter the secondary sphere 84 with their pick-up ends 92 positioned approximately at the center of the secondary sphere 84. When the sphere 78 is in contact with the cryogenic liquid 16 inside the inner shell 14, the liquid 16 enters the sphere 78 through the openings 80. The wicking material 82 draws the cryogenic liquid 16 up into the sphere 78 to a level such that the cryogenic liquid 16 flows through the openings 92 and fills into the secondary sphere 84. As shown, the cryogenic liquid 16 fills the secondary sphere 84 by capillary action to a level above the center point thereof and sufficient for fluid flow communication with the pick-up end of the withdrawal conduits 58. The pick-up end of conduits 58 are fixed at the center point of secondary sphere 84 so that no matter the orientation of sphere 84, there is always fluid flow communication with the conduits 58.

While not shown in the drawings, it is also contemplated by the scope of the present invention that the openings 86 of the conduits 58 can be disposed directly in the wicking material. In that case, the use of the secondary sphere 84 is not needed. Also, while not shown in the drawings, it will be readily apparent to those skilled in the art that the float-type pick-up head such as float 64 in FIG. 1 can also be provided with a wicking material inside the float to ensure contact of the liquid with the conduits 58, even when the liquid quantity is nearly depleted.

Figure 8:
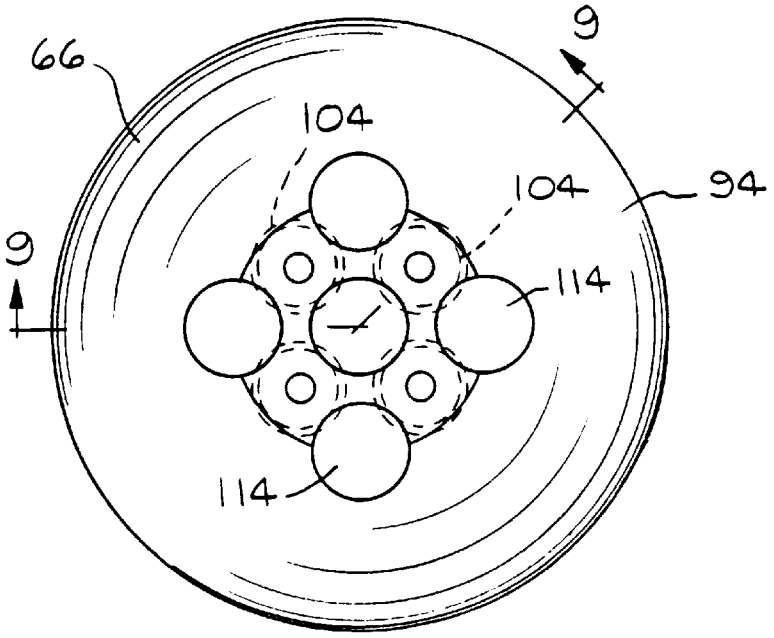
FIG. 8 is a bottom plan view of the sinker-type liquid pick-up head means shown in FIGS. 4 to 5.
Figure 9:
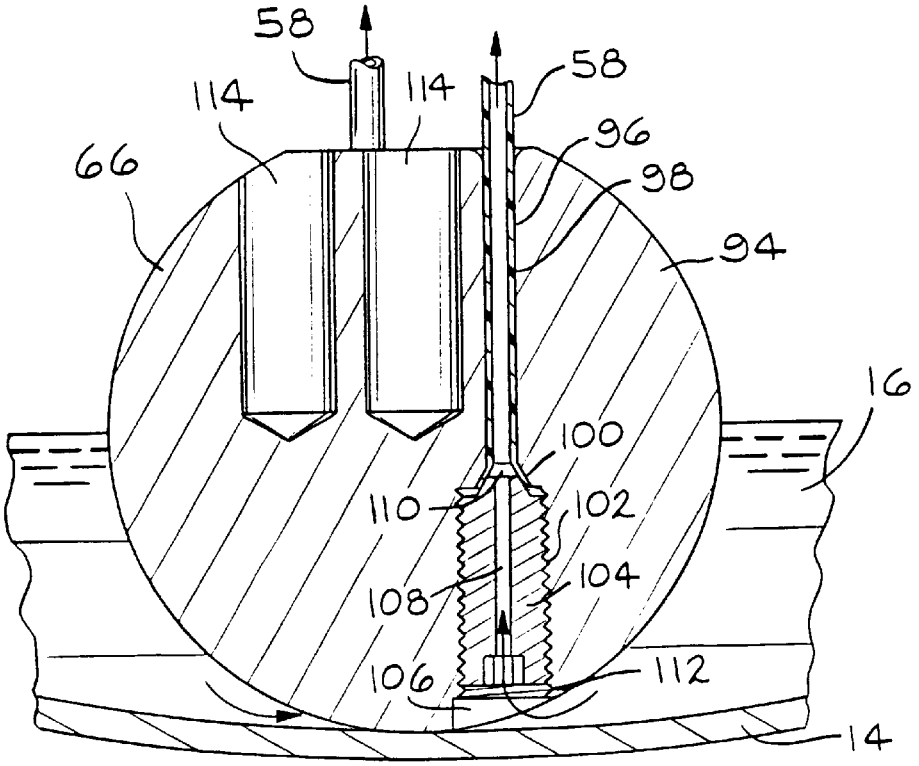
FIG. 9 is a cross-sectional view along line 9—9 of FIG. 8.

Another embodiment of the sinker-type 66 liquid pick-up head is shown in FIGS. 8 and 9, and it comprises a spherically-shaped weighted member 94. Although sphere 94 is preferably made of a metal material having a sufficient mass to seek the low side of the inner surface of the inner shell 14, it can also be made of a plastic or other materials. In the latter case, the sphere 94 is weighted, for example by differential weight 74 shown in FIG. 3, to ensure that the withdrawal conduits 58 are always immersed in the cryogenic liquid 16 at the low side of the inner shell 14.

Spherical member 94 is provided with a sufficient number of through bores to receive the withdrawal conduits 58. There can be as few as one conduit 58, or as many as four or more of them. FIG. 9 shows an exemplary conduit bore 96 comprising a first diameter passage 98 extending from an upper position on sphere 94 to an outwardly tapered frusto-conically shaped section 100. Passage 98 is sized to receive the withdrawal conduits 58 in a closely spaced relationship. Frusto-conical section 100 leads to a threaded bore 102 having a diameter sized to receive a threaded insert 104. Insert 104 has a first, large diameter opening 106 leading to a second inner fluid opening 108 having a lesser diameter extending to a central tap 110 provided with a frusto-conical shape. With the withdrawal conduits 58 received in the passage 98 such that the pick-up end of tube 62 extends into the threaded bore 102, the insert 104 is threaded therein to cause the tap 110 to capture the pick-up end of the withdrawal conduits 58 between the tap 110 and the frusto-conical section 100 of passage 98. A lock ring 112 is then inserted into the threaded bore 102 abutting the insert 104 to lock the insert 104 and captured conduit 62 in place. A similar construction exists for the other withdrawal conduits 58.

The spherical member 94 is completed by a plurality of blind bores 114 drilled or otherwise formed extending therein. The blind bores 114 are provided from both upper and lower positions on the sphere 94 and serve to remove weight from the sphere.

FIG. 10 shows still another embodiment of a sinker-type 66 liquid pick-up head comprising a generally hollow sphere 116 having the withdrawal conduits 58 associated therewith. Sphere 116 has a plurality of openings or perforations 118 through its sidewall which provide for fluid flow of the cryogenic liquid 16 into and out of the interior thereof. A weighted block 120 having a sufficient number of bores to receive the respective withdrawal conduits 58 is enclosed inside sphere 116. Bore 122 is exemplary and it has a first portion 124 sized to receive one of the withdrawal conduits 58 in a closely spaced relationship therewith. The first portion 124 of bore 122 leads to a second portion 126 having an outwardly extending frusto-conical taper that in turn forms into a cylindrically shaped portion. The cylindrical portion threadingly receives an insert 128 that captures the pick-up end of the withdrawal conduit 58 there and in fluid flow communication with the cryogenic liquid 16 when the sphere 116 is immersed in the liquid. Sphere 116 is not shown immersed in cryogenic liquid 16 in FIG. 10.

Sphere 116 is further provided with a number of tube openings 130 that receive the withdrawal conduits 58 for passage therein and eventually into the block 120. An elastomeric washer 132 is fitted around each withdrawal conduit on the inside of sphere 116 while individual grommets 134 surround the tubes 62 proximate the outer surface of the sphere 116. The grommets 134 abut the outer surface of the sphere 116 and help prevent chaffing and wear of the withdrawal conduits 58 against the opening 130.

Figure 2:
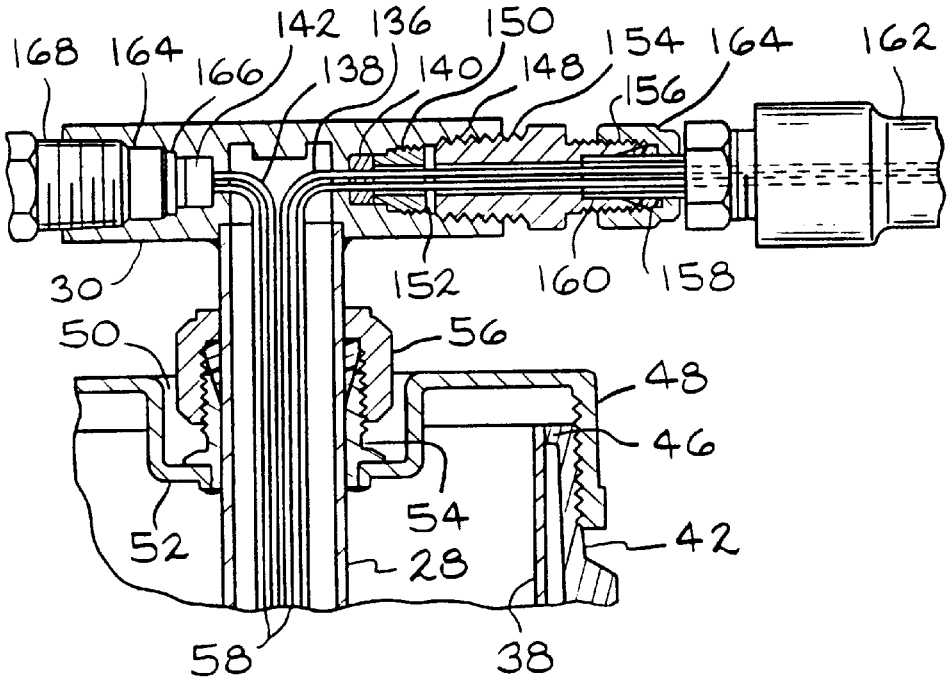
FIG. 2 is an enlarged and broken away, partial elevational, partial cross-sectional view of one pair of capillary tubes 136 of the liquid withdrawal conduit means 58 passing through a septum 140.

As shown in FIGS. 1, 2 and 4, the withdrawal conduits 58 are in fluid flow communication between the pick-up head 60 through tube 28 to an upper end thereof where they separate into two pairs of conduits 136 and 138. Each conduit pair 136 and 138 passes through a corresponding pressure barrier, such as septums 140 and 142 disposed inside passages in the manifold block 30 and lead into respective heat exchangers 144 and 146 (shown in dashed lines in FIG. 1). The bifurcation of the withdrawn liquid into two heat exchangers 144 and 146 benefits the dynamics of vaporization of the liquid to a gaseous phase and helps maintain a uniform pressure profile through the entire length of the system. However, the use of two heat exchangers is not necessary for proper functioning of the present invention.

Septum 140 is exemplary. As particularly shown in FIG. 2, the pair of conduits 136 communicate through the septum 140 received in a passage 148 in the manifold block 30. The septum 140 is secured in passage 148 with a nut 150 threaded therein. A washer 152 abuts the nut 150 and is locked in place with a fitting 154 threaded into the passage 148. The downstream end of fitting 154 is provided with an inner frusto-conically shaped taper 156 that receives an annular elastomeric wedge 158 sealed around an intermediate conduit 160 leading to a heat exchanger conduit 162 connected to heat exchanger 144. Finally, a union nut 164 is threaded onto the downstream end of the fitting 154 to secure the seal 158 around the intermediate conduit 160. This construction ensures that the septum 140 captures the pair of conduits 136 sealed in respective openings therethrough so that there is little or no communication of pressure (or mass) between the inside of the inner shell 14 and the endothermic heat exchanger 144, other than the communication path afforded by the inside of the pair of conduits 136 themselves. The other pair of conduits 138 and its septum 142 is similar in construction and, as shown in FIGS. 1, 2, 4 and 10, it includes a passage 164 in manifold block 30, the passage 164 receiving a nut 166, a washer and a fitting 168 with a union nut 170 threaded onto the fitting 168. An intermediate conduit 172 leads from fitting 168 to a heat exchanger conduit 174 connected to heat exchanger 146.

The outlet of the flexible conduit pairs 136 and 138, after penetrating the septa 140, 142, extend sufficiently downstream of the Dewar container 10 such that the liquid emerging therefrom impinges upon the heat exchangers 144, 146 to vaporize and/or traverse a path to where the liquid can vaporize readily. The heat exchangers 144 and 146, which serve as a removal means, each receive about one half of the liquid removed from the container and they serve to transfer heat from the ambient atmosphere to the cryogenic liquid 16, which preferably is a liquefied breathable gas mixture, to vaporize the liquid to a gas and then to warm the gas to a breathable temperature. An outboard end of the endothermic heat exchangers 144, 146 merges at a manifold (not shown) that connects to a flexible breathing hose 176 that supplies the warmed gas to the breathing pressure regulator 18 and an associated facepiece 20 worn by the user breathing or otherwise consuming the gas mixture, as shown schematically in FIG. 1. Thus, the septa 140, 142 ensure that the sole path of pressure and mass communication between the inside of the inner shell 14 and the heat exchangers 144, 146 is through the withdrawal conduit 58 to maintain the uniform system pressure up to the regulator. The cryogenic liquid 16 is preferably at a saturated liquid pressure of between about 100 to 130 psig, and this operating pressure is transmitted through the entire length of the withdrawal system. For a more detailed description of the heat exchangers 144, 146 and the flow of liquid and/or gas through them, reference is made to U.S. Pat. No. 5,572,880 to Frustaci et al., entitled "Apparatus For Providing A Conditioned Airflow Inside A Microenvironment and Method", which is assigned to the assignee of the present invention.

In Use

Dewar container 10 is intended for use by people needing to breath in a hostile environment where the atmosphere may not be conducive to supporting life. In that respect and initially referring to FIG. 1, a user will first don the facepiece 20 and associated breathing gas regulator 18 while the container 10 is carried on the back by a harness, as is well known to those of ordinary skill in the art.

Inner shell 14 has previously been filled with cryogenic liquid 16 at a liquid saturation pressure of about 100 to 130 psig. The cryogenic liquid 16 is preferably a breathable gas mixture. The regulator 18 associated with the facepiece 20 is then actuated and breathing begins. The various pick-up heads means 60, i.e. the float-type members shown in FIGS. 1 and 3 and the sinker-type members shown in FIGS. 4 to 10 ensure that the inlet to the withdrawal conduits 58 are in fluid flow communication with the liquid 16, independent of the spatial orientation of the Dewar 10. The withdrawal conduits split into the conduit pairs 136 and 138 which transmit through the septa 140, 142 and deliver the liquid 16 to the respective heat exchangers 144 and 146. The septa 140, 142 ensure that the only communication path between the inside of the inner shell 14 and the endothermic heat exchangers 144, 146 is afforded by the withdrawal conduit 58 themselves. The outlet of the withdrawal conduit 58 empties into the heat exchangers 144, 146 which transfer heat from the ambient atmosphere to the cryogenic liquid, thereby vaporizing the liquid to a gas and then warm the gas to about ambient temperature. Alternatively, the gas can be warmed to a cooler temperature than ambient if so desired. The heat exchangers 144 and 146 maintain the concentration of the various constituents consisting of the liquified gas mixture at a similar concentration as they are in the liquid phase. The breathable gas mixture flows from the heat exchangers to a manifold (not shown) that connects to the flexible breathing hose 176 (FIG. 1) leading to the regulator 18 which is attached to the facepiece 20.

Thus, with no breathing demand, cryogenic liquid 16 at about 100 to 130 psig is transmitted through the conduit pairs 136 and 138 and the heat exchangers 144 and 146 where heat is transferred to the liquid to first provide a raised fluid and as further heat is transferred, the gas is warmed to about ambient temperature and made suitable for breathing. During an inhalation event, this breathable gas communicates to the regulator 18 attached to the facepiece 20 such that the entire system including the liquid withdrawal conduit means 58, the heat exchangers 144 and 146 and the breathing hose 176 leading to the facepiece regulator 18 are approximately at the pressure of the saturated liquid, i.e. at about 100 to 130 psig, neglecting pressure drop consideration of the heat exchangers and the flexible hose (not shown) leading from the heat exchangers to the regulator). As is well known to those skilled in the art, the regulator provides the breathing gas to the facepiece 20 on demand while maintaining a positive pressure inside the facepiece of about 0 to 2 inches water column above the pressure outside the facepiece. Further, the description of the present apparatus with respect to an inhalation event should not be construed as a limitation. The regulator 18, which serves as a consumption means for the breathable gas, also can be used in a constant flow mode or any other mode of operation, as is well known to those skilled in the art.

As the cryogenic liquid 16 is removed from the container 10 and moves through the heat exchangers 144 and 146 where heat is transferred to it from ambient surroundings, the pressure of the resulting gas phase increases. When the pressure in the heat exchangers 144 and 146 essentially equals the pressure inside the inner shell 14, i.e. about 100 to 130 psig, (neglecting hardware pressure drop considerations) liquid 16 removal through the conduits 58 ceases. Then, any withdrawal of warmed gas from the downstream end of the heat exchangers, for instance as the user inhales during a normal respiratory demand requirement, causes the pressure in the heat exchangers 144 and 146 to decrease. This creates a pressure differential between the inside of the Dewar container 10 and the endothermic heat exchangers 144 and 146 through the withdrawal conduit 58 while simultaneously promoting vaporization of any liquid 16 residing in the heat exchangers. The pressure differential again causes liquid 16 to flow in the flexible withdrawal conduits 58 from the relatively high pressure Dewar container to the lower pressure heat exchanger 144 and 146 side to replace the gaseous volume removed or consumed from the heat exchangers 144 and 146 during the breathing event until pressure equilibrium is again established. Consequently, fluid flow from the inner shell 14 of the Dewar container 10 through the withdrawal conduits 58 to the heat exchangers 144 and 146 is governed by any withdrawal or removal of gas from the system, for example, the user's respiratory demand requirements.

If it is desired to operate the breathing regulator 18 and associated facepiece 20 (FIG. 1) at a nominal pressure of about 100 to 130 psig, then the inner shell 14 is charged with a liquid mixture saturated at a pressure within this range. For all intents and purposes, the head gases inside the inner shell 14, do not get consumed during the respiratory demand cycles because of the septa 140, 142, and the liquid removal or withdrawal system operates at 100 to 130 psig until the liquid contents are depleted. There is of course a nominal decrease in saturation pressure of liquid as it is consumed through flashing of the liquid inside the container. The liquid flashes in order to generate gas which occupies the displaced liquid contents consumed during the normal respiratory demand requirements.

If the pressure in the endothermic heat exchangers increases to a pressure greater than the pressure inside the inner shell 14, a slight back flow of gases occurs from the heat exchangers to the inner shell 14 until pressure equalization is again re-established and/or until a pressure relief valve (not shown) opens. It should be noted, however, that heat transfer to stagnant gases inside the heat exchangers 144 and 146 is relatively small, and consequently the liquid withdrawal apparatus of the present invention is very stable with respect to pressure build-up during use relative to the desired breathing pressure operating range.

It is intended that the foregoing description only be illustrative of the present invention and that the present invention is limited only by the hereafter appended claims.

What is claimed is:

1. An assembly for withdrawing a liquid from a closed container, the assembly comprising:

a) a conduit comprising an upstream open end disposed inside the container and an opposed downstream open end located outside the container, wherein at least a portion of the conduit is of a flexible material such that the conduit reaches all of an enclosed volume of the container intended to contain the liquid upon changes in the orientation of the container while maintaining free and open flow therethrough;

b) a pick-up provided at the upstream open end of the conduit, wherein the pick-up comprises an enclosing side wall surrounding the upstream open end of the conduit disposed therein;

c) a wicking material housed inside the pick-up in a substantially surrounding relationship with the upstream open end of the conduit, wherein the enclosing side wall of the pick-up is provided with at least one perforation for enabling the wicking material to draw the liquid into the pick-up to thereby maintain the upstream open end of the conduit in contact with the liquid upon changes in the orientation of the container; and d) a removal device located outside the container and in fluid flow communication with the downstream open end of the conduit, wherein when an outer pressure in the removal device is less than an inner pressure taken inside the container, and upon changes in the orientation of the container, the liquid is caused to flow through the conduit from the enclosed volume to the removal device.

2. The assembly of claim 1 wherein the liquid is a cryogenic liquid and the conduit is of a flexible, synthetic polymeric material that is not adversely affected by contact with the cryogenic liquid.

3. The assembly of claim 2 wherein heat is added to the cryogenic liquid in the removal device to vaporize the liquid to a gas and wherein liquid removal from the container ceases at such time as the pressure inside the container essentially equals the pressure in the removal device.

4. The assembly of claim 1 wherein at least the portion of the conduit that reaches all of the enclosed volume intended to contain liquid is of polytetrafluoroethylene.

5. The assembly of claim 4 wherein the pick-up comprises a sinker submerged in the liquid.

6. The assembly of claim 4 wherein the pick-up comprises a float that rests on or slightly submerged below the surface of the liquid.

7. The assembly of claim 1 wherein the conduit comprises a plurality of flexible tubes.

8. An assembly for withdrawing a liquid from a closed container, the assembly comprising:

a) a conduit comprising an upstream open end disposed inside the container and an opposed downstream open end located outside the container;

b) a pick-up provided at the upstream open end of the conduit, wherein the pick-up comprises an enclosing side wall surrounding the upstream open end of the conduit disposed therein;

c) a wicking material housed inside the pick-up in a substantially surrounding relationship with the upstream open end of the conduit, wherein the enclosing side wall of the pick-up is provided with at least one perforation for enabling the wicking material to draw the liquid into the pick-up and wherein at least a portion of the conduit is of a flexible material that the conduit means provides for free and open flow to maintain contact of the pick-up with the liquid for withdrawing the liquid from the container at all times; and d) a removal device located outside the container and in fluid flow communication with the downstream open end of the conduit, wherein when an outer pressure in the removal device is less than an inner pressure taken inside the container, the liquid in contact with the pick-up is caused to flow through the conduit from inside the container to the removal device.

9. The assembly of claim 8 wherein at least the portion of the conduit that provides for withdrawing the liquid at all times is of polytetrafluoroethylene.

10. The assembly of claim 8 wherein the pick-up comprises a sinker submerged in the liquid.

11. The assembly of claim 8 wherein the pick-up comprises a float that rests on or is submerged slightly below the surface of the liquid.

12. The assembly of claim 9 wherein the liquid is a cryogenic liquid and the conduit is of a flexible, synthetic polymeric material that is not adversely affected by contact with the cryogenic liquid.

13. The assembly of claim 12 wherein heat is added to the cryogenic liquid in the removal device to vaporize the liquid to a gas and wherein liquid removal from the container ceases at such time as the pressure inside the container essentially equals the pressure in the removal device.

14. An assembly for withdrawing cryogenic liquid contents from a closed container independent of the spatial orientation thereof, the assembly comprising:

a) a flexible conduit comprising an upstream open end disposed inside the container and an opposed downstream open end located outside the container;

b) a pick-up provided at the upstream open end of the conduit, wherein the pick-up comprises an enclosing side wall surrounding the upstream open end of the conduit disposed therein;

c) a wicking material housed inside the pick-up in a substantially surrounding relationship with the upstream open end of the conduit, and wherein the enclosing side wall of the pick-up is provided with at least one perforation for enabling the wicking material to draw the liquid into the pick-up and wherein at least a portion of the upstream open end of the conduit is of a synthetic polymeric material that is not adversely affected by the cryogenic liquid to thereby maintain contact with the liquid contents independent of the spatial orientation of the container;

d) a heat exchanger provided outside the container and in fluid flow communication with the downstream open end of the conduit, wherein independent of the spatial orientation of the container, the liquid contents are movable from inside the container to the heat exchanger via the conduit to transfer heat to the liquid and provide a raised-energy fluid and wherein liquid removal from the container ceases at such time as the pressure inside the container essentially equals the pressure in the heat exchanger; and e) a consumption device provided to consume the raised-energy fluid from the heat exchanger so that a pressure differential is set up between the heat exchanger and the inside of the container through the conduit which causes the liquid contents to flow through the conduit and into the heat exchanger as the consumption device consumes the raised-energy fluid.

15. The assembly of claim 14 wherein the pick-up comprises a sinker submerged in the liquid.

16. The assembly of claim 14 wherein the pick-up comprises a float that rests upon or slightly below the surface of the liquid.

17. The assembly of claim 14 wherein at least the portion of the conduit that contacts the liquid contents independent of the spatial orientation of the container comprises a plurality of polytetrafluorethylene tubes.

18. The assembly of claim 14 wherein the cryogenic liquid is comprised of a breathable liquefied gas mixture containing oxygen and nitrogen.

19. The assembly of claim 14 wherein the container includes an inner container provided to store the cryogenic liquid and an insulator housing the inner container in a surrounding relationship to retard ambient heat conduction and radiation to the cryogenic liquid inside the inner container.

20. The assembly of claim 14 wherein the cryogenic liquid comprises a breathable gas mixture and wherein the consumption device comprises a facepiece that is worn by a user of the apparatus to breath the breathable gas mixture.

21. A method for withdrawing a liquid from a closed container, comprising the steps of:

a) providing a flexible conduit comprising an upstream open end disposed inside the container and an opposed downstream open end located outside the container, wherein at least a portion of the conduit is of a flexible material such that the conduit reaches all areas of the container intended to contain liquid upon changes in the orientation of the container while providing for free and open flow therethrough;

b) providing a pick-up at the upstream open end of the conduit, the pick-up comprising an enclosing side wall surrounding the upstream open end of the conduit disposed therein;

c) a wicking material housed inside the pick-up in a substantially surrounding relationship with the upstream open end of the conduit, and wherein the enclosing side wall of the pick-up has at least one perforation for enabling the wicking material to draw the liquid into the pick-up, thereby maintaining the upstream open end of the conduit in contact with the liquid;

d) providing a removal device located outside the container with the downstream open end of the conduit leading to the removal device;

e) creating a pressure differential between an outer pressure taken in the removal device and an inner pressure taken inside the container; and f) withdrawing the liquid from the container to the removal device through the conduit when the outer pressure communicating through the conduit is less than the inner pressure inside the container.

22. The method of claim 21 including providing the liquid as a cryogenic liquid and the conduit of a flexible, synthetic polymeric material that is not adversely affected by contact with the cryogenic liquid.

23. The method of claim 22 wherein the removal device vaporizes the liquid to a breathable gas delivered to a user to support the user's life.

24. The method of claim 21 wherein the pick-up further comprises a sinker submerged in the liquid regardless the spatial orientation of the container.

25. The method of claim 21 wherein the pick-up further comprises a float resting on or submerged slightly below the surface of the liquid.

26. The method of claim 21 wherein at least the portion of the conduit that contacts the liquid contents of the container is of a polytetrafluoroethylene.

27. A method for withdrawing cryogenic liquid contents from a closed container independent of the spatial orientation thereof, comprising the steps of:

a) providing a flexible conduit comprising an upstream open end disposed inside the container and an opposed downstream open end located outside the container, wherein at least a portion of the conduit is of a flexible material such that the conduit contacts the liquid contents independent of the spatial orientation of the container while maintaining free and open flow therethrough;

b) providing a pick-up at the upstream open end of the conduit, the pick-up comprising an enclosing side wall surrounding the upstream open end of the conduit disposed therein;

c) a wicking material housed inside the pick-up in a substantially surrounding relationship with the upstream open end of the conduit, and wherein the enclosing side wall of the pick-up has at least one perforation for enabling the wicking material to draw the liquid into the pick-up, thereby maintaining the upstream open end of the pick-up in contact with the liquid;

d) providing a heat exchanger outside the container and in fluid flow communication with the downstream open end of the conduit;

e) withdrawing the liquid contents from the container and moving the withdrawn liquid to the heat exchanger via the conduit to conduct heat energy to the liquid and provide a raised-energy fluid; and f) consuming the raised-energy fluid from the heat exchanger, thereby setting up a pressure differential between the heat exchanger and the inside of the container causing the liquid contents to flow through the conduit and into the heat exchanger, and ceasing liquid consumption from the container at such time as the pressure inside the container essentially equals the pressure in the heat exchanger.

28. The method of claim 27 including providing the cryogenic liquid as a mixture of liquid oxygen and liquid nitrogen such that the raised-energy fluid is a breathable gas consumed by a user to support the user's respiratory requirements.

29. The method of claim 27 wherein at least the portion of the conduit that contacts the liquid contents of the container is of a polytetrafluoroethylene.

* * * * *

UNITED STATES PATENT AND TRADEMARK OFFICE

CERTIFICATE OF CORRECTION

PATENT NO. : 6,012,453
DATED : Jan. 11, 2000
INVENTOR(S) : Tsals et al.

It is certified that error appears in the above-identified patent and that said Letters Patent is hereby corrected as shown below:

Col. 12, lines 1-2 - Delete "that the conduit means provides for free and open flow".

Signed and Sealed this

Twenty-fifth Day of July, 2000

*Attest:*

*Attesting Officer*

Q. TODD DICKINSON

*Director of Patents and Trademarks*